US006693605B1

(12) United States Patent
Crouch et al.

(10) Patent No.: US 6,693,605 B1
(45) Date of Patent: Feb. 17, 2004

(54) VARIABLE QUASIOPTICAL WAVE PLATE SYSTEM AND METHODS OF MAKING AND USING

(75) Inventors: David D. Crouch, Corona, CA (US); Alan A. Rattray, Alta Loma, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/231,937

(22) Filed: Aug. 30, 2002

(51) Int. Cl.[7] ..... H01Q 15/24

(52) U.S. Cl. ..... 343/909

(58) Field of Search ..... 343/909, 756; 333/21 A

(56) References Cited

U.S. PATENT DOCUMENTS 2,908,001 A * 10/1959 Kelly ..... 343/756

* cited by examiner

*Primary Examiner*—Michael C. Wimer
(74) *Attorney, Agent, or Firm*—Mark A. Saralino; Thomas J. Finn; Glenn H. Lenzen, Jr.

(57) ABSTRACT

A wave plate (10) formed of a perforated metallic plate of a particular thickness (L) has circular holes (12) that induce a change in the polarization of an electromagnetic wave passing through the holes in the plate. By choosing the proper hole diameter, the hole spacing in orthogonal directions, and the plate thickness, the desired relative phase shift is achieved with maximum transmission and minimal reflection. Two or more axially-aligned wave plates form a variable wave plate system. By changing the relative rotational positions of the wave plates, the polarization of the electromagnetic wave passing through the system can be selectively varied.

20 Claims, 4 Drawing Sheets

VARIABLE QUASIOPTICAL WAVE PLATE SYSTEM AND METHODS OF MAKING AND USING

FIELD OF THE INVENTION

The present invention is related to a wave plate, system and methods of making and using same, and more particularly, to a variable quasioptical wave plate that is particularly useful for millimeter wave frequencies, as well as a system including same, and methods of making and using such a wave plate and system.

BACKGROUND OF THE INVENTION

Wave plates are devices that utilize an anisotropy to change the polarization (direction of the electric field vector) of an incident electromagnetic wave, i.e., to change the direction of the electric field vector. Wave plates frequently are used in optical systems, to induce a change in the polarization of an incident electromagnetic wave, such as light. Such optical wave plates typically are constructed from a birefringent material, i.e., one having different indices of refraction for different incident polarizations. For example, an optical wave plate may be a dielectric plate having different refractive indices in orthogonal x and y directions (with the z direction normal to the surface of the plate in an orthogonal coordinate system). More specifically, a wave plate may be made from a birefringent material such as calcite, for example, whose optic axis is parallel to the surface. In terms of the polarization of the incident wave directed to a wave plate, there are two cases of interest: when the electric field vector of the incident electromagnetic wave is parallel to the optic axis, and when it is perpendicular to the optic axis. The component of the incident wave whose electric vector is parallel to the optic axis is known as the extraordinary wave (or e-wave for short), and the wave component whose electric vector is perpendicular to the optic axis is known as the ordinary wave (o-wave). Each wave or component sees a different index of refraction, $n_e$ for the extraordinary wave, and $n_o$ for the ordinary wave. As a result, upon propagation through a plate of thickness L, the difference in phase between the two wave components is given by $$\Delta\phi = {}^{2\pi}/_{\lambda}(n_e - n_o)L,$$

where $\lambda$ is the free-space wavelength. An incident wave that is linearly polarized and whose electric field vector makes an angle of 45° relative to the optic axis may be considered to have e-wave and o-wave components having equal magnitudes and phases.

If L is chosen so that $\Delta\phi=2\pi$, the device, known as a full-wave plate, has no effect on the polarization of the transmitted electromagnetic wave. If L is chosen so that $\Delta\phi=\pi$, the polarization of the transmitted electromagnetic wave is rotated about an axis parallel to the direction of propagation by 90° relative to that of the incident wave, and the resulting device is known as a half-wave plate. If L is chosen so that $\Delta\phi=\pi/2$, the wave plate induces a 90° phase shift between the initially in-phase electric-field components of the incident wave, resulting in a circularly polarized transmitted wave. Such a wave plate is known as a quarter-wave plate. Finally, if L is chosen so that $\Delta\phi=\pi/4$, the plate induces a 45° shift in phase between the initially in-phase components of the incident wave. Such a wave plate is known as an eighth-wave plate.

Wave plates may be used in quasioptical millimeter-wave systems. However, the wave plates described above are seldom used at millimeter-wave frequencies (frequencies at which the wavelength is between 1 and 10 millimeters) for two primary reasons. First, accurate measurements of the anisotropic properties of dielectrics at millimeter-wave frequencies are very limited. Second, most materials have relatively high losses at millimeter-wave frequencies, limiting their usefulness. This problem is compounded for anisotropic materials, since the loss also tends to be anisotropic, producing an absorption that is dependent on the electric-field polarization.

Wave plates also have been made from isotropic dielectrics by inducing an artificial anisotropy. For example, half- and quarter-wave plates have been made from Rexolite® (a low loss polymer available from C-LEC Plastics, Inc. of Beverly, N.J., U.S.A.) by machining a series of parallel grooves in the surface of a plate. An incident wave whose electric field is polarized parallel to the grooves will see a different index of refraction than an incident wave whose electric field is polarized perpendicular to the grooves. This technique is effective at low power levels; however, at high power levels the low thermal conductivity of Rexolite® causes excess heat to accumulate until the plate fails.

For high power levels, wave plates have been constructed of metal plates by fabricating periodic arrays of rectangular or elliptical slots in the plates. For example, see Paul F. Goldsmith, *Quasioptical Systems: Gaussian Beam Quasioptical Propagation and Applications* (1998). Each slot acts like a waveguide. For a rectangular waveguide of width W and height H (where W>H), for example, the phase shift per unit length for the $TE_{10}$ mode (electric field polarized parallel to H) is different from that for the $TE_{01}$ mode (electric field polarized parallel to W). A similar relationship exists for an elliptical waveguide. By properly choosing the slot dimensions, the thickness of the plate, and the periodicity of the slots, the desired relative phase shift can be imposed between the orthogonally-polarized components of a normally-incident wave, and the reflected power for each component of the incident wave can be minimized. Such a wave plate, being of all-metal construction, can handle very high power levels, particularly if it is actively cooled around the edges, or includes internal cooling channels.

A slotted metal or metallic wave plate like that just described is difficult and expensive to fabricate, however, as the slots for millimeter-wave wavelengths are too small to be made by conventional machining techniques. Typically, the rectangular or elliptical slots have to be formed using some form of electron-discharge machining (EDM). If wire EDM is used, a hole first is machined where each slot is to be placed, then the EDM wire is threaded through the hole. After cutting the slot to the desired dimensions, the wire is cut and is manually threaded through the next hole. As this technique is very labor intensive, it is not cost effective if more than one or two wave plates are to be constructed.

Another form of EDM uses a mandrel. To construct a wave plate of the type described above, the mandrel has a "waffle" pattern of raised rectangular protrusions extending from its surface. The mandrel is then used to "burn" the desired pattern into the metal plate. This type of EDM results in gradual deformation of the mandrel, which has to be trimmed after burning part way through the plate and eventually has to be replaced. A wave plate constructed in this manner would likely be less expensive than one constructed using wire EDM, but generally is still cost-prohibitive.

SUMMARY OF THE INVENTION

The present invention provides a wave plate that is based on a perforated metallic plate. However, unlike the slotted metallic plates previously used in highpower applications, the wave plate provided by the present invention has circular through-holes and induces an anisotropy by forming holes of a predetermined size in a predetermined pattern. More specifically, by proper choice of the hole diameter and plate thickness, and by different spacing of the holes in respective orthogonal x and y directions, the desired relative phase difference between orthogonally-polarized components is achieved while minimizing the reflected power for both polarization components and maximizing power transmission through the plate.

The present invention replaces the rectangular or elliptical slots with circular holes, eliminating the need for EDM and resulting in significantly lower manufacturing costs. A wave plate made with circular holes can be made with conventional machining techniques, eliminating the need for EDM and resulting in a significant cost advantage over wave plates made with rectangular or elliptical slots. Using conventional machining techniques, the holes can be reamed or drilled, for example, using a numerically-controlled milling machine. These conventional machining techniques also are much faster than EDM. Once the initial one-time set-up costs have been incurred (e.g., tooling, programming the milling machine, etc.), recurring costs are relatively low, significantly lower than for electron-discharge machining.

In an exemplary embodiment, the present invention provides a wave plate for inducing a change in the polarization components of an incident electromagnetic wave that includes a plate having a metal surface and an array of circular through-holes having a predetermined diameter. The diameter of each hole, the thickness of the plate, and the relative positions of the holes combine to change the polarization of the electromagnetic wave as it passes from an incident side of the plate to an outlet side of the plate while minimizing the reflected power.

According to the present invention, such a wave plate may also include one or more of the following features: a wave plate wherein in an orthogonal grid on the surface of the plate, the through-holes are spaced a first distance in an x-direction and are spaced a second distance different from the first distance in a y-direction;

- a wave plate wherein the plate is metal;
- a wave plate wherein the plate is a nonmetallic material having a metal coating;
- a wave plate wherein the plate is substantially flat;
- a wave plate wherein the plate has a uniform thickness;
- a wave plate wherein the plate has a uniform thickness of about 251 mils (about 6.4 mm);
- a wave plate wherein the diameter of the holes is uniform throughout the array of holes;
- a wave plate wherein the hole radius is about 39 mils (about 1.0 mm);
- a wave plate wherein the hole diameter, plate thickness and hole spacing are selected for frequencies greater than about 20 GHz;
- a wave plate wherein the hole diameter, plate thickness and hole spacing are selected for a frequency of about 95 GHz;
- a wave plate wherein the nearest-neighbor distance between adjacent holes is uniform in a first direction and the nearest-neighbor distance in a second orthogonal direction is uniform, but the nearest-neighbor distances in the first direction and in the second direction are not the same; and
- a wave plate wherein the nearest-neighbor distance between adjacent holes in the first direction is about 103.5 mils (about 2.6 mm), and the nearest-neighbor distance between adjacent holes in the second direction is about 118.0 mils (about 3.0 mm).

The present invention also provides a variable wave plate system that includes a plurality of axially aligned wave plates.

In addition, the present invention provides a method of making a wave plate that includes selecting the hole diameter, the plate thickness and the hole spacing for maximum transmission, desired phase shift and minimum reflection, and forming the holes in the plate. The step of forming the holes may include at least one of machine reaming, electron-discharge machining, and drilling.

The present invention also provides a method of effecting a relative shift in phase between the polarization components of an electromagnetic wave that includes the steps of providing at least one wave plate and directing an electromagnetic wave through the holes in the at least one wave plate.

The present invention further provides a method that includes providing at least two wave plates arranged in parallel, axially aligned, and spaced apart at least two wavelengths, and rotating at least one wave plate about a central axis to vary the change in polarization.

Also provided by the present invention is a variable polarization rotation system. The system includes at least two wave plates with adjacent wave plates spaced from one another by at least two wavelengths of the intended incident electromagnetic wave. For example, the system may include four wave plates.

The foregoing and other features of the invention are hereinafter fully described and particularly pointed out in the claims, the following description and annexed drawings setting forth in detail a certain illustrative embodiment of the invention, this embodiment being indicative, however, of but one of the various ways in which the principles of the invention may be employed.

DETAILED DESCRIPTION

Figure 1:
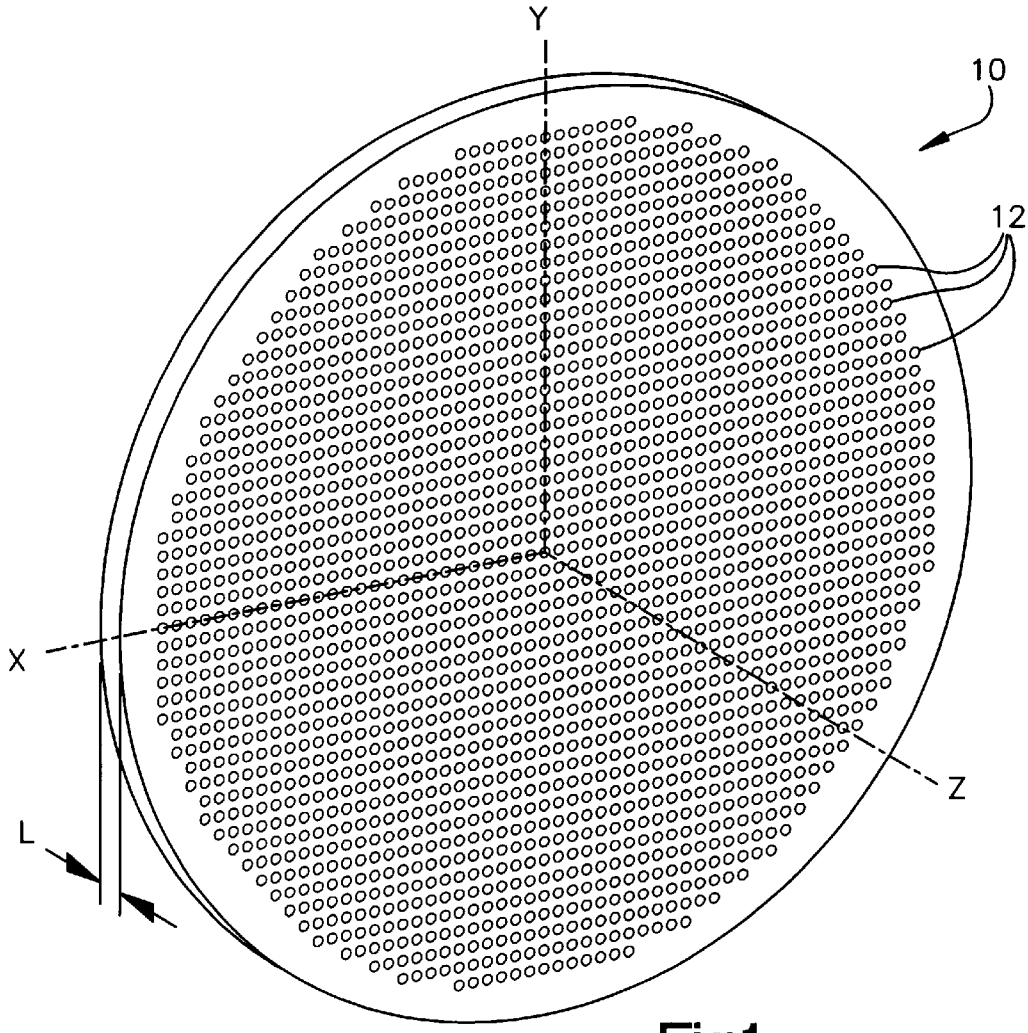
FIG. 1 is an illustration of a representative eighth-wave plate formed in accordance with the present invention.

Referring now to the drawings in detail, the present invention provides a variable quasioptical wave plate for inducing a relative shift in phase between orthogonal components of an incident wave of electromagnetic energy, particularly at millimeter-wave frequencies, and a method of making such a wave plate. An exemplary wave plate 10 according to an embodiment of the present invention is shown in FIG. 1. The plate is substantially flat with parallel incident (front) and outlet (back) surfaces. The wave plate has a plurality of circular through-holes 12 arranged in periodic distribution across the surface of the plate. The hole distribution density in one direction is sufficiently different from the density in an orthogonal direction, to generate the desired phase shift between the polarization components.

Although the illustrated wave plate 10 has through-holes 12 arrayed on a rectangular grid, the holes may be arrayed in any manner, such as a triangular grid, as long as the density of holes in one direction is different from the density of the holes in an orthogonal direction sufficiently to generate the desired phase shift. In an orthogonal coordinate system with the z-axis perpendicular to the surface of the plate and the x- and y-axes parallel to the surface of the plate, the spacing between adjacent holes in an x direction parallel to the x-axis ($d_x$) is different than the spacing between adjacent holes in a y-direction parallel to the y-axis ($d_y$) Referring additionally to FIG. 2, $d_x$ does not equal $d_y$. The through-holes have right cylindrical shapes, with a uniform circular cross-section along the z-axis of each hole. The holes are parallel to each other and to the z-axis, and generally extend perpendicular to the surface of the plate. The holes have substantially the same radius, a.

For high-power applications, the wave plate 10 is preferably metal, although a metallic plate having a metal coating on its surface could be used for lower power applications. The wave plate 10 is sized to support an array of through-holes that is larger than the expected cross-sectional area of a beam of electromagnetic energy with which the plate is to be used. Thus, as no boundaries of the wave plate are "seen" by the incident wave, the array of through-holes appears to the incident wave to be infinite relative to the incident wave of electromagnetic energy. For example, for a collimated beam of circular cross-section and Gaussian intensity profile (i.e., a Gaussian beam) having a diameter of approximately three inches (about 76 mm), a hole array having a diameter of about four inches (about 102 mm) on a plate having a diameter of about five inches (about 127 mm) is acceptable.

The wave plate 10 is designed for maximum transmission of the incident electromagnetic wave with minimum reflection. An exemplary wave plate is described below that can induce a 45° phase shift between orthogonal polarization components of a linearly polarized incident electromagnetic wave. Because the holes are circular, the effect of an individual hole on the incident electromagnetic wave is the same regardless of the orientation of the incident wave polarization components. However, since the hole spacing in one direction (e.g., the x-direction) is different than the hole spacing in an orthogonal direction (e.g., the y-direction), the wave plate is able to impose different phase shifts on incident electric-field components polarized in orthogonal directions from an incident side of the wave plate to an outlet side of the wave plate. The representative wave plate 10 shown in FIG. 1 is an eighth-wave plate that induces a 45° relative phase shift on the transmitted x- and y-components of the electric field.

The periodicity of the structure and the assumed plane-wave excitation make it possible to calculate the return loss and the phase shifts imposed on the orthogonal (e.g., x- and y-components) components of the transmitted wave by approximating the reflected and transmitted waves with a finite number of discrete plane waves (Floquet modes) and the fields in the circular holes with a finite number of circular waveguide modes. By applying boundary conditions to the tangential electric and magnetic fields at the incident and outlet sides of the wave plate, i.e., by imposing continuity on the tangential electric and magnetic fields, one can determine the coefficients of the waveguide and Floquet modes. These coefficients form the basis for a matrix that can be resolved to determine the unknown waveguide mode amplitudes. The return loss and the total phase shifts imposed upon the x- and y-components, e.g., of the transmitted wave are then derived from the solution to this matrix equation. For further details on this method, see Chao-Chun Chen, "Transmission of Microwaves Through Perforated Flat Plates of Finite Thickness," IEEE Trans. On Microwave Theory and Techniques, vol. MTT-21, no. 1 (January 1973).

The use of circular holes (rather than rectangular or elliptical slots, e.g.) is not trivial. Prior rectangular and elliptical slots each apply different phase shifts to the orthogonal components of an incident electric field, whereas circular holes do not. The present invention relies on the different spacing of the holes in orthogonal directions to achieve the shift in phase between the orthogonal polarization components rather than different orthogonal dimensions of regularly spaced slots. Consequently, the wave plate provided by the present invention operates under a completely different principle than the wave plates having elliptical or rectangular slots.

Figure 2:
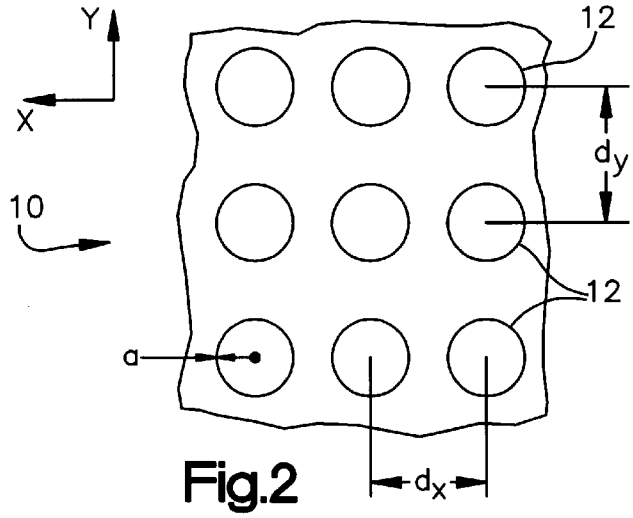
FIG. 2 is a diagram illustrating the spacing and radius of the holes in a wave plate formed in accordance with the present invention.

For an exemplary eighth-wave plate, the dimensions are shown in the following list (many others are possible). Reference may be made to FIGS. 1 and 2.

a=Hole Radius=about 39 mils (about 1 mm)

$d_x$=Array Period in x Direction=about 103.5 mils (about 2.6 mm)

$d_y$=Array Period in y Direction=about 118.0 mils (about 3.0 mm)

L=Plate Thickness=about 251 mils (about 6.4 mm)

Figure 3A:
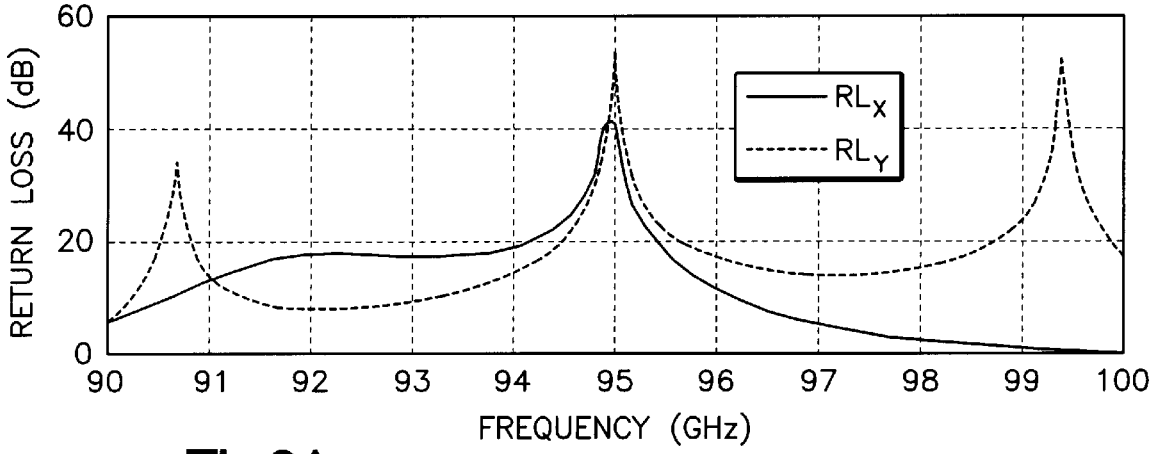
FIG. 3A is a chart illustrating variations in the return loss as a function of frequency in the wave plate of FIG. 1.
Figure 3B:
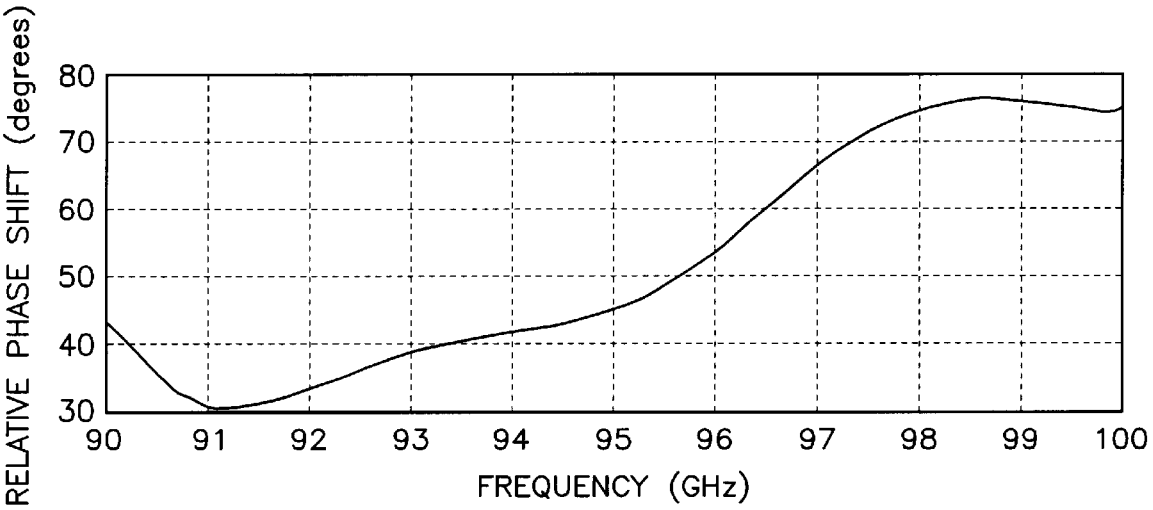
FIG. 3B is a chart illustrating relative phase shift as a function of frequency in the wave plate of FIG. 1.

The ability of the wave plate to efficiently transmit an incident electromagnetic wave from one side to the other without excessive reflection is quantified by the return losses for the x- and y-components of the incident wave, which are shown as functions of frequency in FIGS. 3A and 3B. Here the return losses for the two polarization components are defined by $$RL_x = -10\log_{10}\left(\frac{P^x_{ref}}{P^x_{inc}}\right), \qquad RL_y = -10\log_{10}\left(\frac{P^y_{ref}}{P^y_{inc}}\right),$$

where $P_{inc}^{x(y)}$ is the incident power in the x(y) component of the incident wave, and $P_{ref}^{x(y)}$ is the reflected power in the x(y) component of the reflected wave. Note that a large return loss denotes a small amount of reflected power. At the design frequency of about 95 GHz, the return losses for x-polarized and y-polarized incident electromagnetic waves are about 41.1 dB and 53.13 dB, respectively, and the return loss for each polarization component is at least 20 dB for frequencies between about 94.5 and 95.4 GHz. The bandwidth is significant as it indicates that small deviations from the ideal dimensions due to manufacturing tolerances can be accommodated without excessive loss of performance. As is evident from the graphs (FIGS. 3A and 3B), the relative phase shift is frequency-dependent.

The eighth-wave plate shown in FIG. 1 also can be used as a building block to construct quarter- and half-wave plate systems. For example, referring now to FIG. 4, consider an idealized wave plate 14 that perfectly transmits all polarizations, and imposes a phase shift $\Phi_x$ on a normally-incident electromagnetic wave polarized along the x-axis and a phase shift $\Phi_y$ on a normally-incident electromagnetic wave polarized along the y-axis. If the incident wave is polarized at an angle $\phi_1$ with respect to the x-axis (see FIG. 4), then the transmitted wave is $$\vec{E}_{trans}^{1}=E_0(e^{j\Phi_x}\cos\phi_1\hat{e}_x+e^{j\Phi_y}\sin\phi_1\hat{e}_y)$$

Figure 4:
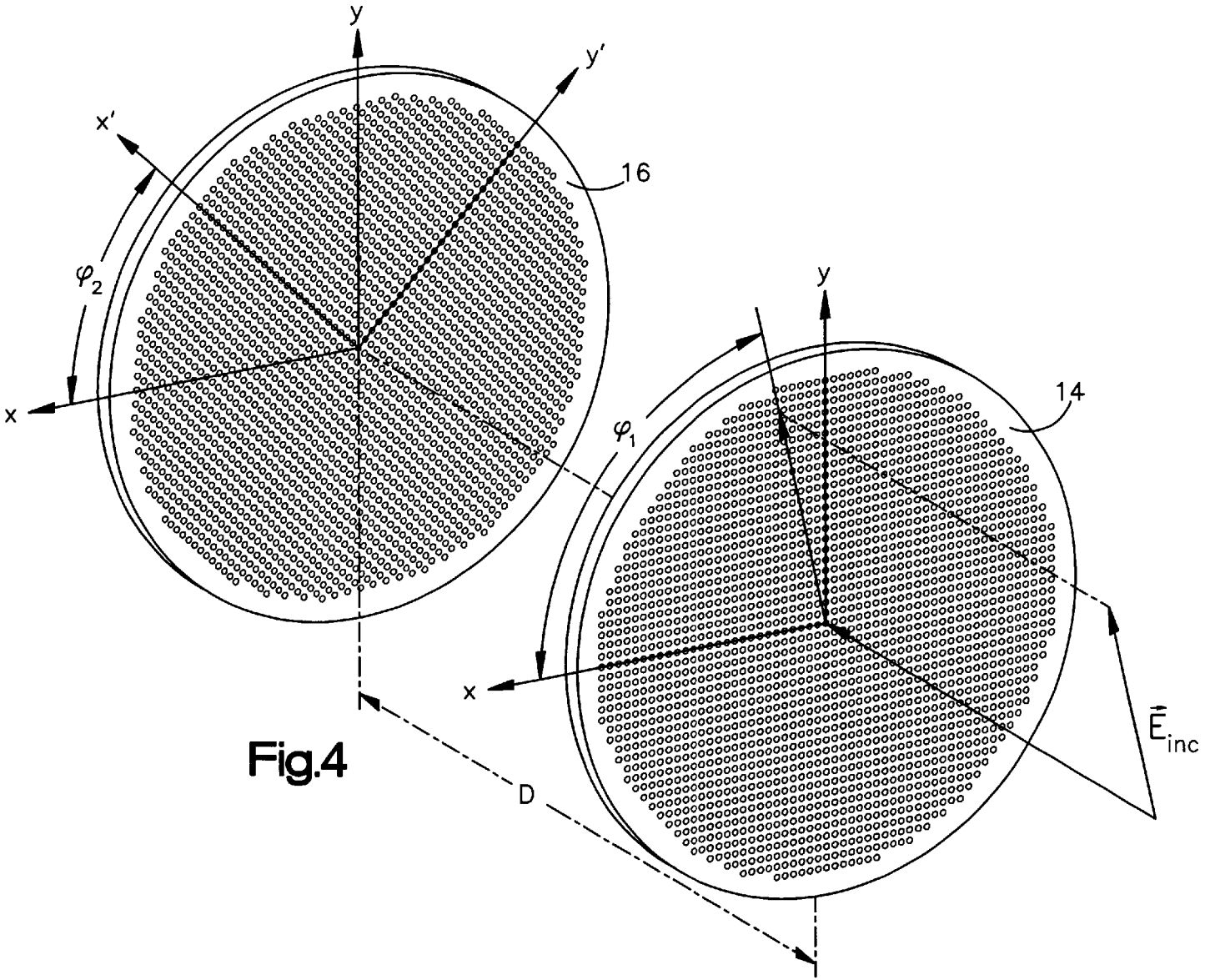
FIG. 4 is an illustration of a representative variable wave plate constructed from two eighth-wave plates in accordance with the present invention.

This wave is incident on a second, identical wave plate 16 that is rotated by an angle $\phi_2$ about the z-axis with respect to the first wave plate 14, as illustrated in FIG. 4. The second wave plate 16 is spaced from the first wave plate 14 a distance, D, of at least two wavelengths to minimize or to eliminate near field effects at the outlet side of the first wave plate 14. If the polarization-independent phase shift due to propagation between the first and second plates 14, 16 is ignored, the wave transmitted by the second plate 16 is $$\vec{E}_{trans}^{2}=E_0(e^{j2\Phi_x}\cos\phi_1\cos\phi_2+e^{j(\Phi_x+\Phi_y)}\sin\phi_1\sin\phi_2)\hat{e}'_x+E_0(-e^{j(\Phi_x+\Phi_y)}\cos\phi_1\sin\phi_2+e^{j2\Phi_y}\sin\phi_1\cos\phi_2)\hat{e}'_y,$$

where $\hat{e}'_x$ and $\hat{e}'_y$ are unit vectors in the x' and y' directions respectively (in an orthogonal coordinate system rotated by an angle of $\phi_2$ relative to the orthogonal coordinate system of the previous e.g., the first or upstream wave plate). If the two identical wave plates are aligned along an optical path, i.e., the x- and y-axes of the two plates are parallel to each other, then $\phi_2=0$, and $$\vec{E}_{trans}^{2}|_{\phi_2=0}=E_0(e^{j2\Phi_x}\cos\phi_1\hat{e}_x+e^{j2\Phi_y}\sin\phi_1\hat{e}_y)$$

If both plates are eighth-wave plates, and $\Phi_y=\Phi_x+\pi/4$, then $$\vec{E}_{trans}^{2}|_{\phi_2=0}=E_0e^{j2\Phi_x}(\cos\phi_1\hat{e}_x+j\sin\phi_1\hat{e}_y),$$

which describes a circularly-polarized transmitted wave when $\phi_1=45°$. If the second wave plate is rotated so that it is orthogonal to the first wave plate, i.e., so that the second wave plate is rotated by 90° about its own axis with respect to the first wave plate, then $\phi_2=90°$, and $$\vec{E}_{trans}^{2}|_{\phi_2=90°}=E_0e^{j(\Phi_x+\Phi_y)}(\cos\phi_1\hat{e}_x+\sin\phi_1\hat{e}_y)=\vec{E}_{inc}e^{j(\Phi_x+\Phi_y)};$$

that is, when the two wave plates are orthogonal to each other the second wave plate undoes the effects from the first wave plate, and the incident wave passes through with no change other than a polarization-independent overall phase shift. While this in itself is not beneficial, it illustrates that if $\phi_1=45°$, the polarization of the transmitted wave can be varied from linear to circular by rotating the second eighth-wave plate about the z-axis through an angle of 90° relative to the first eighth-wave plate.

Although the performance of real wave plates is not as ideal as a mathematical model, e.g., some finite fraction of the incident wave is reflected, the wave plate can be designed to have a low reflection coefficient (i.e., a high return loss) so that its behavior approximates an ideal wave plate.

Figure 5:
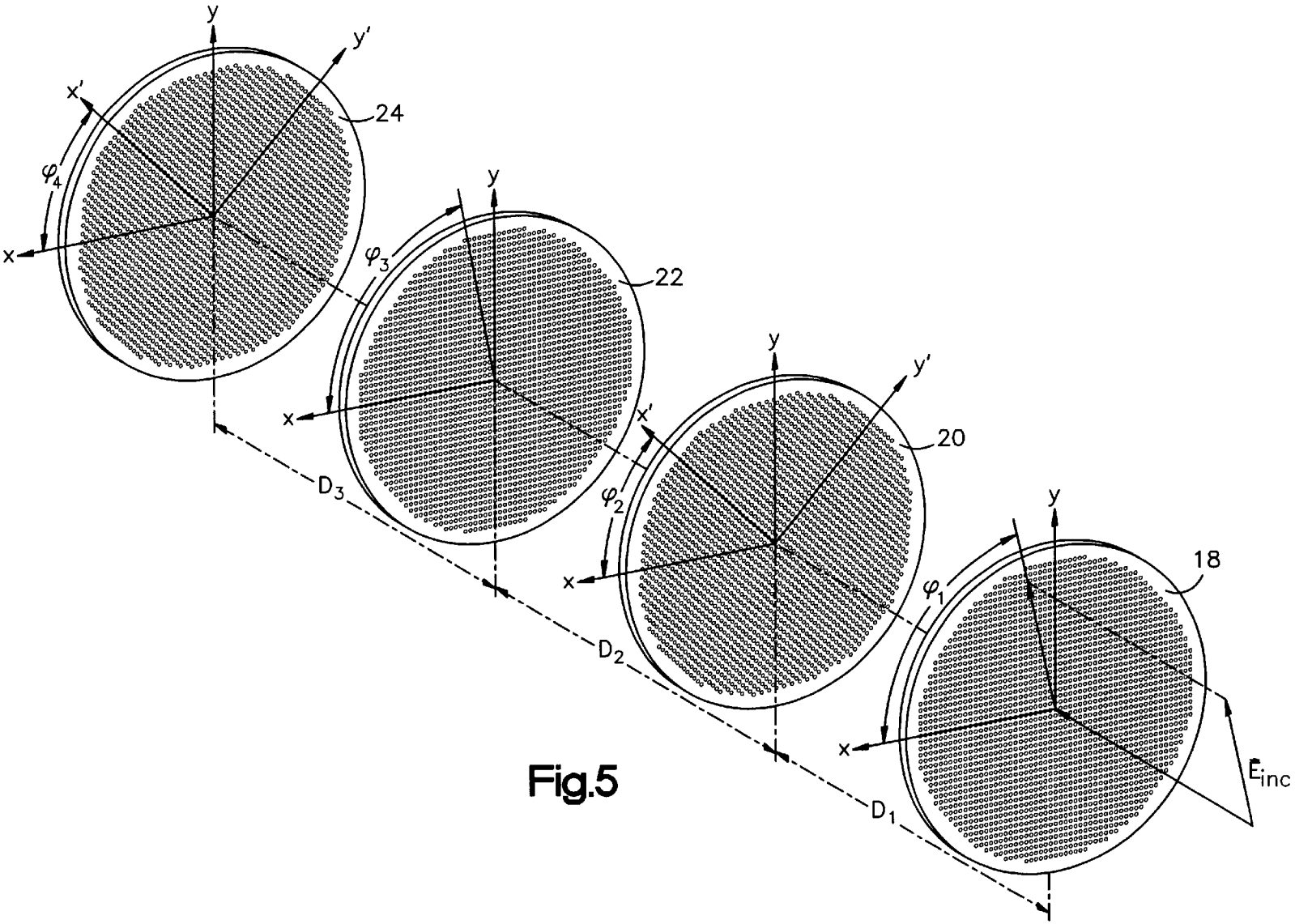
FIG. 5 is an illustration of a representative variable wave plate constructed from four eighth-wave plates in accordance with the present invention.

Variable wave plates having even greater capability can be constructed by combining four identical eighth-wave plates 18, 20, 22 and 24, as shown in FIG. 5. Each pair of adjacent plates is spaced apart a distance $D_1$, $D_2$ or $D_3$ of at least about two wavelengths, is parallel and is axially aligned along an optical path. Assume that the first three plates 18, 20 and 22 are fixed and the fourth plate 24 is free to rotate about the z-axis. If $\phi_1=45°$ and if the x- and y-axes of the first two plates 18 and 20 are aligned with each other, then the first two wave plates 18 and 20 yield a circularly-polarized output, which is then incident on the second set of plates 22 and 24. If the x- and y-axes of the second set of plates 22 and 24 are aligned with each other and with those of the first set of plates 18 and 20, they impose another relative phase shift of 90° between the x- and y-components of the transmitted wave. As a result, the output is once again linearly polarized, but its' polarization is rotated by 90° with respect to that of the incident wave. In this configuration, the wave plate system acts as a half-wave plate. If the fourth plate 24 is rotated by 90° about the z-axis, then the second set of plates 22 and 24 merely impose the same phase shift on each component of the incident circularly-polarized wave so that the transmitted output wave also is circularly polarized. In this configuration, the wave plate system once again acts as a quarter-wave plate. In other words, the invention provides a variable wave plate system that can be varied from a quarter-wave plate to a half-wave plate by rotating the last eighth-wave plate 24 through an angle of 90° about the z-axis.

Now assume that the two pairs of plates 18 and 20 and 22 and 24 are aligned with each other, i.e., the x- and y-axes of plate 18 are aligned with those of plate 20, and the x- and y-axes of plate 22 are aligned with those of plate 24, so that the four plates constitute a pair of quarter-wave plates. However, the second pair of plates 22 and 24, while fixed with respect to each other, is allowed to rotate with respect to the first pair of plates 18 and 20. If a linearly-polarized plane wave is incident on the first plate 18 with $\phi_1=45°$, then the wave transmitted by the second plate 20 is circularly polarized, i.e., $$E_2^{trans}=\frac{E_0}{\sqrt{2}}e^{j2\phi_x}(\hat{e}_x+j\hat{e}_y),$$

as described previously. If this circularly polarized wave is now incident on a third metallic quarter-wave plate 22 that has been rotated about the z-axis by an angle θ, the wave transmitted by the fourth plate 24 is $$E_4^{trans}=E_0e^{j(4\phi_x+\theta)}\left\{\cos\left(\theta-\frac{\pi}{4}\right)\hat{e}_x+\sin\left(\theta-\frac{\pi}{4}\right)\hat{e}_y\right\}.$$

Like the wave incident on the first plate 18, this wave is linearly polarized, but its polarization has been rotated about the z-axis by an angle of θ–90° with respect to the polarization of the incident wave. For example, if θ=0°, i.e., so that the x- and y-axes of the first and last metallic quarter-wave plates 18 and 24 are aligned, then the electric-field vector of the transmitted wave is rotated by −90° with respect to that of the incident wave. Or, if θ=90°, the electric-field vector of the transmitted wave is parallel to that of the incident wave. By rotating the second metallic quarter-wave plate 20 about the z-axis by angles between 0° and 90°, the electric-field vector of the linearly polarized transmitted wave can be rotated by any angle with respect to that of the incident wave. In this embodiment, the combination of four metallic quarter-wave plates 18, 20, 22 and 24 constitutes a variable polarization rotator.

Although the invention has been shown and described with respect to certain illustrated embodiments, equivalent alterations and modifications will occur to others skilled in the art upon reading and understanding the specification and the annexed drawings. In particular regard to the various functions performed by the above described integers (components, assemblies, devices, configurations, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiments of the invention. In addition, while a particular feature of the invention may have been described above with respect to only one of several illustrated embodiments, such a feature may be combined with one or more other features of the other embodiment, as maybe desired and advantageous for any given or particular application.

What is claimed is:

1. A wave plate for inducing a change in the polarization components of an incident electromagnetic wave, comprising: a plate having a metal surface and an array of circular through-holes having a predetermined diameter, wherein the diameter of each hole, the thickness of the plate, and the relative positions of the holes, the holes having a spacing in one direction that is different from a spacing of holes in an orthogonal direction, combine to change the polarization of the electromagnetic wave as it passes from an incident side of the plate to an outlet side of the plate while minimizing the reflected power.

2. A wave plate as set forth in claim 1, wherein on an orthogonal grid on the surface of the plate, the through-holes are spaced a first distance in an x-direction and are spaced a second distance different from the first distance in a y-direction.

3. A wave plate as set forth in claim 1, wherein the plate is metal.

4. A wave plate as set forth in claim 1, wherein the plate is a nonmetallic material having a metal coating.

5. A wave plate as set forth in claim 1, wherein the plate is substantially flat.

6. A wave plate as set forth in claim 1, wherein the plate has a uniform thickness.

7. A wave plate as set forth in claim 1, wherein the plate has a uniform thickness of about 251 mils (about 6.4 mm).

8. A wave plate as set forth in claim 1, wherein the diameter of the holes is uniform throughout the array of holes.

9. A wave plate as set forth in claim 1, wherein the hole radius is about 39 mils (about 1.0 mm).

10. A wave plate as set forth in claim 1, wherein the hole diameter, plate thickness and hole spacing are selected for frequencies greater than about 20 GHz.

11. A wave plate as set forth in claim 1, wherein the hole diameter, plate thickness and hole spacing are selected for a frequency of about 95 GHz.

12. A wave plate as set forth in claim 1, wherein the nearest-neighbor distance between adjacent holes is uniform in a first direction and the nearest-neighbor distance in a second, orthogonal direction is uniform, but the nearest-neighbor distances in the first direction and in the second direction are not the same.

13. A wave plate as set forth in claim 12, wherein the nearest-neighbor distance between adjacent holes in the first direction is about 103.5 mils (about 2.6 mm), and the nearest-neighbor distance between adjacent holes in the second direction is about 118.0 mils (about 3.0 mm).

14. A variable wave plate system, comprising a plurality of axially aligned wave plates, each wave plate including a plate having a metal surface and an array of circular through-holes having a predetermined diameter, wherein the diameter of each hole, the thickness of the plate, and the relative positions of the holes, the holes having a spacing in one direction that is different from a spacing of holes in an orthogonal direction, combine to change the polarization of the electromagnetic wave as it passes from an incident side of the plate to an outlet side of the plate while minimizing the reflected power.

15. A method of making a wave plate having a metal surface and an array of circular through-holes having a predetermined diameter, wherein the diameter of each hole, the thickness of the plate, and the relative positions of the holes combine to change the polarization of the electromagnetic wave as it passes from an incident side of the plate to an outlet side of the plate while minimizing the reflected power, the method comprising: selecting the hole diameter, the plate thickness and the hole spacing, the holes having a spacing in one direction that is different from a spacing of holes in an orthogonal direction, for maximum transmission, desired phase shift and minimum reflection, and forming the holes in the plate.

16. A method as set forth in claim 15, wherein forming the holes includes at least one of machine reaming, electron-discharge machining, and drilling.

17. A method of effecting a relative shift in phase between the polarization components of an electromagnetic wave, comprising the steps of providing at least one wave plate having a metal surface and an array of circular through-holes having a predetermined diameter, wherein the diameter of each hole, the thickness of the plate, and the relative positions of the holes, the holes having a spacing in one direction that is different from a spacing of holes in an orthogonal direction, combine to change the polarization of the electromagnetic wave as it passes from an incident side of the plate to an outlet side of the plate while minimizing the reflected power; and directing an electromagnetic wave through the holes in at least one wave plate.

18. A method as set forth in claim 17, further comprising providing at least two wave plates arranged in parallel, axially aligned, and spaced apart at least two wavelengths, and rotating at least one wave plate about a central axis to vary the change in polarization.

19. A variable polarization rotation system, comprising at least two wave plates, adjacent wave plates spaced from one another by at least two wavelengths of the intended incident electromagnetic wave, each wave plate having a metal surface and an array of circular through-holes having a predetermined diameter, wherein the diameter of each hole, the thickness of the plate, and the relative positions of the holes, the holes having a spacing in one direction that is different from a spacing of holes in an orthogonal direction, combine to change the polarization of the electromagnetic wave as it passes from an incident side of the plate to an outlet side of the plate while minimizing the reflected power.

20. A system as set forth in claim 19, comprising four wave plates.

* * * * *